United States Patent [19]

Graziani et al.

[11] Patent Number: 4,720,337

[45] Date of Patent: Jan. 19, 1988

[54] HYDRODEWAXING METHOD WITH INTERSTAGE SEPARATION OF LIGHT PRODUCTS

[75] Inventors: Kenneth R. Graziani, Woodbury; James R. Katzer, Moorestown; Chwan P. Kyan, Manuta, all of N.J.

[73] Assignee: Mobil Oil Corporation, New York, N.Y.

[21] Appl. No.: 23,183

[22] Filed: Mar. 9, 1987

Related U.S. Application Data

[63] Continuation-in-part of Ser. No. 685,564, Dec. 24, 1984, Pat. No. 4,648,957, and a continuation-in-part of Ser. No. 816,092, Jan. 3, 1986, Pat. No. 4,695,364.

[51] Int. Cl.[4] ..... C10G 65/10; C10G 65/12

[52] U.S. Cl. ..... 208/58; 208/59; 208/97

[58] Field of Search ..... 208/97, 58, 59, 71, 208/97; 585/502, 10, 18

[56] References Cited

U.S. PATENT DOCUMENTS

| | | | |
|---|---|---|---|
| 3,180,818 | 4/1965 | Claussen | 208/59 |
| 3,463,724 | 8/1969 | Langlois et al. | 208/59 X |
| 4,176,048 | 11/1979 | Corns et al. | 208/59 |
| 4,283,271 | 8/1981 | Garwood et al. | 208/59 |
| 4,283,272 | 8/1981 | Garwood et al. | 208/59 |
| 4,400,265 | 8/1983 | Shen | 208/97 |
| 4,414,097 | 11/1983 | Chester | 208/59 |
| 4,574,043 | 3/1986 | Chester et al. | 208/59 |
| 4,599,162 | 7/1986 | Yen | 208/59 |
| 4,648,957 | 3/1987 | Graziani | 208/58 |

*Primary Examiner*—Helen M. S. Sneed
*Assistant Examiner*—Glenn Caldarola
*Attorney, Agent, or Firm*—Alexander J. McKillop; Michael G. Gilman; Malcolm D. Keen

[57] ABSTRACT

A catalytic dewaxing process in which a hydrocarbon feed, usually a lubricant feed, is catalytically dewaxed in at least two catalytic dewaxing stages with an interstage separation of the light ends which are subjected to hydrogenation to saturate the olefins before the hydrotreated product is passed to the second dewaxing stage. The hydrotreated fraction may be the entire fraction below the lube boiling range with a lube feed or a lower boiling portion of it with separated higher boiling portions such as naphtha and distillate by-passing the second dewaxing step.

25 Claims, 6 Drawing Figures

OLEFINIC BOND YIELD
CUT
111-125
C6 -330
330-610
610-F+
TLP
TLP
NAPHTHA
C5's
LUBE
DISTILLATE
CHARGE
YIELDS OF OLEFINIC BONDS, MOL% CHARGE
1/LHSV
0
10
20
30
40
50
.5
1
1.5
2
2.5

HYDRODEWAXING METHOD WITH INTERSTAGE SEPARATION OF LIGHT PRODUCTS

CROSS REFERENCE TO RELATED APPLICATIONS

This application is a continuation-in-part of copending application Ser. No. 685,564 filed Dec. 24, 1984 U.S. Pat. No. 4,648,957), and Ser. No. 816,092, filed Jan. 3, 1986 U.S. Pat. No. 4,695,364. The disclosures of those two applications are incorporated in this application by reference.

FIELD OF THE INVENTION

This invention relates to a method for dewaxing heavy distillates and residual hydrocarbon liquids. More particularly, it relates to a method and apparatus for dewaxing heavy distillates and residual hydrocarbon liquids comprising multistage dewaxing with separation of a vapor stream between stages. It may also include catalytic oligomerization of the separated vapor stream to convert olefins in the vapor stream to gasoline, distillate and lube boiling range materials, and downstream units to hydrofinish and recover lubes.

BACKGROUND OF THE INVENTION

The dewaxing of hydrocarbons to liquids of lower pour point is a process of great commercial significance. Although alternatives exist, it is now evident that the use of shape-selective catalysts, such as the intermediate pore size zeolite catalysts, to selectively convert those paraffins that contribute the most to high pour points has many advantages over other methods. Thus, catalytic dewaxing over shape-selective zeolites will likely be the most commercially significant dewaxing process in the hydrocarbon processing industry.

Catalytic dewaxing of hydrocarbon oils to reduce the temperature at which precipitation of waxy hydrocarbons occurs is a known process and is described, for example, in the Oil and Gas Journal, Jan. 6, 1975, pages 69–73. A number of patents have also described catalytic dewaxing processes. For example, U.S. Pat. No. Re. 28,398 describes a process for catalytic dewaxing with a catalyst comprising a zeolite of the ZSM-5 type and a hydrogenation/dehydrogenation component. U.S. Pat. No. 3,956,102 describes a process for hydrodewaxing a gas oil with a ZSM-5 type catalyst. U.S. Pat. No. 4,100,056 describes a mordenite catalyst containing a Group VI or Group VIII metal may be used to dewax a distillate from a waxy crude. U.S. Pat. No. 3,755,138 describes a process for mild solvent dewaxing to remove high quality wax from a lube stock, which is then catalytically dewaxed to specification pour point.

Catalytic dewaxing processes may be followed by other processing steps such as hydrodesulfurization and denitrogenation in order to improve the qualities of the product. For example, U.S. Pat. No. 3,668,113 describes a catalytic dewaxing process employing a mordenite dewaxing catalyst which is followed by a catalytic hydrodesulfurization step over an alumina-based catalyst. U.S. Pat. No. 4,400,265 describes a catalytic dewaxing-/hydrodewaxing process using a ZSM-5 type catalyst wherein gas oil is catalytically dewaxed followed by hydrodesulfurization in a cascade system.

In catalytic dewaxing processes using shape-selective catalysts, such as the intermediate pore size catalysts such as ZSM-5, the waxy components, particularly the n-paraffins, are cracked by the zeolite into lighter products containing olefinic material. However, these lighter products have a boiling point (b.p.) predominantly 610° F.$^-$. Olefinic fragments are unstable to oxidation; so the dewaxed oil may be subsequently hydrogenated over catalysts to saturate the olefins and improve the oxidation stability of the oil. The hydrogenation catalysts generally used are mild hydrogenation catalysts, such as a $CoMo/Al_2O_3$ type. The color of the oil may also be improved in this hydrofinishing process.

Recent experience with ZSM-5 based catalytic dewaxing has shown that the dewaxing of higher boiling point or residual feeds (greater than 610° F. b.p.) pose significantly greater problems than that experienced with lighter distillate feeds. Accelerated catalyst aging is particularly a problem for the heavier feeds which cause catalysts to display a more rapid loss of activity relative to a fixed pour point specification (e.g. −7° C.). This loss of activity results in higher aging rates (so that the operating temperature of the dewaxing catalyst must be increased to maintain desired conversion) and lower on-stream capacity factors.

It would be desirable to find a way to prolong hydrodewaxing catalyst activity at low cost.

In copending patent application Ser. No. 685,564, filed Dec. 24, 1984, U.S. Pat. No. 4,648,957 on Mar. 10, 1987) there is described a method for reducing catalyst aging rate by separation of olefins during the dewaxing process. The entire disclosure of Ser. No. 685,564 (U.S. Pat. No. 4,648,957) is incorporated in this specification by reference for a disclosure of that process and its utility with a process for converting the separated olefins to higher boiling products including gasoline, middle distillates and lubricants. The process described in Ser. No. 685,564 (U.S. Pat. No. 4,648,957) was based upon the finding that olefinic intermediates (primary by-products) which are by-products of the catalytic hydrodewaxing reaction which occur predominantly in the distillate and lighter fractions in sizeable quantity, significantly inhibit the dewaxing reactions and, in addition can cause an uncontrolled reactor behavior such as temperature runaway. The process of Ser. No. 685,564, U.S. Pat. No. 4,648,957, removes the olefinic intermediate products as they are formed during the course of the hydrodewaxing reaction so as to simultaneously ensure a controlled reactor behavior. The enhanced activity gives a lower start-of-cycle temperature and a larger operating temperature span, thereby resulting in longer catalyst cycle life.

The olefinic intermediates may be removed as they are formed during the course of the hydrodewaxing reaction and sent through an olefin conversion unit e.g. an MOGDL unit to catalytically oligomerize them into additional low pour point high quality lube. Combining catalytic hydrodewaxing with MOGDL simultaneously enhances the hydrodewaxing catalyst activity, increases the lube yield and ensures a controlled reactor behavior. Furthermore, blending of the low pour MOGDL lube into the main lube product stream reduces the requirement of hydrodewaxing severity to meet a given target pour point.

Co-pending application Ser. No. 816,092, filed Jan. 3, 1986, discloses a process in which the olefins are separated from the partly dewaxed effluent and hydrogen injected. Although that process obviates the problems associated with the presence of the olefins, it requires recycle of hydrogen to an intermediate point in the process which adds to equipment cost and complexing as well as to operational complication. It would be desirable, therefore, to find a simpler way of dealing with the problems arising from the presence of the olefins in the dewaxing stream.

SUMMARY OF THE INVENTION

It has now been found that further improvements in the dewaxing process may be achieved by hydrogenation of the olefins in the light products which are separated during the dewaxing process. The process enhances dewaxing catalyst activity and cycle length, improves stream factor (thereby reducing plant size) with the need to reduce space velocity through the unit and by reducing secondary reactions and reactor exotherms, contributes to smoother operation and potential enhancement of product quality. Furthermore, in spite of the interstage hydrogenative step, the entire process uses a hydrogen circulation rate no greater than that of a standard dewaxing unit without the interstage hydrogenation.

According to the present invention there is therefore provided a catalytic dewaxing process in which a hydrocarbon feedstock is dewaxed to produce a partly dewaxed effluent including unsaturated products of dewaxing (olefins), this effluent stream is separated into a lower boiling stream and a higher boiling stream and the higher boiling stream is subjected to catalytic dewaxing to produce a dewaxed product. The lower boiling stream is subjected to hydrogenation to saturate the unsaturates, especially the olefins produced by the dewaxing, after which the hydrogenated product is passed through the dewaxer with the liquid stream.

The process may be operated with two or more stages of catalytic dewaxing and the separation/hydrogenation may be carried out between any two stages. Preferably it will be carried out between each two stages if there are three or more stages although normally two stages will be sufficient.

The hydrogenative processing of the separated light ends may be carried out effectively by a catalytic hydrotreater using conventional hydrotreating catdalysts i.e. a metal hydrogenative function on a support such as alumina, silica-alumina, silica or another porous oxide or other suitable support material.

The separation may divide the partly dewaxed effluent into light ends (usually a vapor stream under operational conditions) which is sent to the hydrotreater or, alternatively, it may separate light ends and other fractions from the heavier fraction which is to be dewaxed, with the other fractions being withdrawn from the dewaxing sequence at this point. The withdrawn fractions e.g. naphtha and middle distillate may be used as such with or without further processing or, as described below, may be subjected to a final hydrotreating step which conventionally follows the dewaxing to improve product quality and stability.

In more specific terms, the present process comprises the steps of catalytically hydrodewaxing a hydrocarbon feedstock under conditions sufficient to produce a first effluent stream including olefins and having an intermediate pour point of about 30° F. to about 100° F. (−1° to 38° C.); separating the first effluent stream to obtain a first vapor stream comprising the olefins and a first liquid stream; and catalytically hydrodewaxing the first liquid stream under conditions sufficient for producing a second effluent stream having a pour point less than about 30° F. (−1° C.).

The steps of the process are typically carried out under the following conditions when a dewaxed lubricant is to be produced:

(a) the hydrocarbon feedstock is catalytically dewaxed at a temperature in the range from about 500° to about 675° F., a pressure from about 350 to about 650 psig, and a hydrogen feed rate from about 1500 to about 4000 SCF/bbl of the feedstock to produce the first effluent stream having an intermediate pour point, usually of about 50° to about 70° F.;

(b) the first effluent stream is separated to obtain the vapor stream comprising 610° F.− b.p. hydrocarbons, a portion of which are olefinic and to obtain the liquid stream comprising hydrocarbons having an initial boiling point ranging from 610° to 800° F.;

(c) the liquid stream is catalytically dewaxed at a temperature in the range from about 500° to about 675° F., a pressure from about 350 to about 650 psig and a hydrogen feed rate from about 1500 to about 4000 SCF/bbl of the first liquid stream to produce a second , dewaxed effluent stream having a pour point less than about 20° F. (−7° C.);

(d) hydrotreating the second effluent stream to produce a hydrotreating effluent stream and separating the hydrotreated effluent stream to form a lube product;

(e) the vapor stream is hydrotreated over a hydrotreating catalyst at hydrotreating conditions, typically a temperature of 200° to 700° F. and a pressure of 350 to 650 psig consistent with the other process steps.

The overall space velocity for the feedstock hydrodewaxing steps is typically from 0.5 to about 1.0 $hr^{-1}$ LHSV and the ratio of space velocities in the hydrodewaxing steps in a two stage process is typically from about 3:7 to about 7:3.

THE DRAWINGS

In the accompanying drawings:

FIG. 1 is a sequence of graphs (three) showing pilot plant dewaxing data demonstrating the inhibition effect of olefins on dewaxing activity, FIG. 2 is a graph showing the olefinic contents of the various product cuts obtained from dewaxing a lubestock, FIG. 3 is a graph showing the results of an adiabatic reactor simulation, demonstrating the occurrence of an excessive reactor temperature rise in case of an operating upset such as a flow maldistribution, FIG. 4 is a graph showing a significant aging reduction achieved in a two-stage dewaxing when the interstage light products were cascaded through a small hydrotreater to saturate olefins, FIG. 5 is a simplified process schematic of a two stage catalytic dewaxing process with interstage separation of light ends and hydrotreating of the light ends, and FIG. 6 is a simplified process schematic of a two stage catalytic dewaxing process with interstage separation of light ends and other fractions with hydrotreating of the separated light ends.

DETAILED DESCRIPTION

Feedstock

Figure 1:
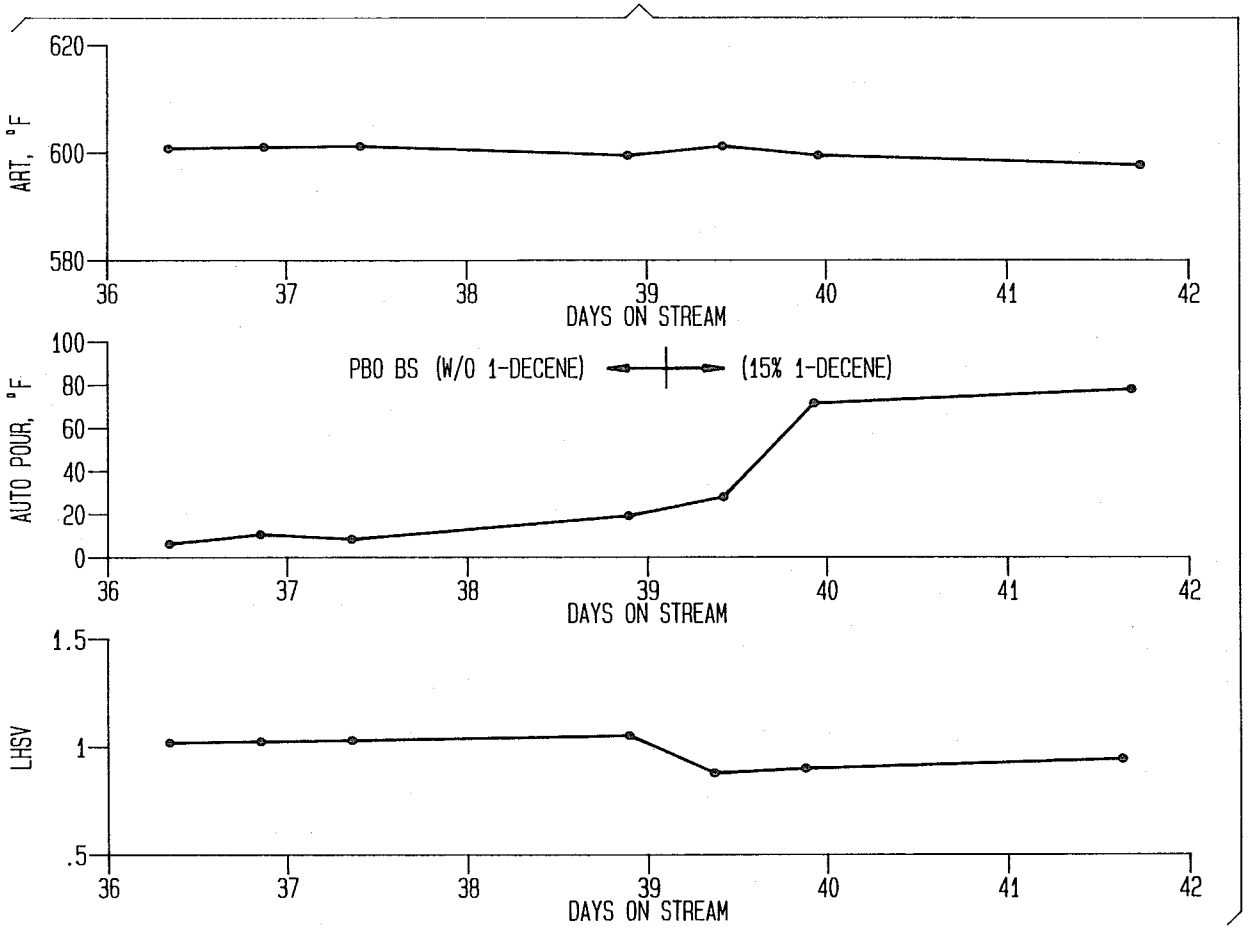

The present process is applicable to feedstocks, including lube stocks, when a low wax content is desired in the final product. The feedstocks may typically comprise hydrocarbons having a 400° F.+ (205° C.) I.B.P. (initial boiling point), particularly those having a 610°

F.+ (320° C.) I.B.P. The feeds may be virgin or pretreated hydrocarbons.

The process is of particular utility for dewaxing lubestocks, that is, relatively paraffinic hydrocarbon stocks having an initial boiling point above 610° F. (320° C.), more commonly above 650° F. (345° C.). The lubestock may be a distillate (neutral) lube stock or a residual stock, produced by the vacuum distillation of a hydrocarbon fraction (usually an atmospheric tower resid) of a suitable crude source. The residual stocks, being relatively highly aromatic in character will normally require an initial deasphalting step e.g. PDA, followed by an aromatic extraction step using a solvent which is selective for aromatics such as phenol, Chlorex, sulfolane, or furfural. The deasphalted, solvent-treated product, usually referred to as bright stock may then be subjected to dewaxing by the present process. The distillate lubestocks, usually referred to as neutral lubestocks are the distllate fractions of the vacuum distillation and are generally suitable for dewaxing after solvent extraction to remove the undesirable low V.I. aromatic components using a solvent as described above.

Dewaxing

The dewaxing steps are carried out in the manner described in Ser. No. 685,564, now U.S. Pat. No. 4,648,957, to which reference is made for a description of the conditions. In summary, the dewaxing is carried out over a dewaxing catalyst which selectively removes the waxy components of the feed, mostly n-paraffins and slightly branched chain paraffins, especially monomethyl paraffins, to produce a dewaxed product of lower pour point and olefins as by-products of the dewaxing process.

The catalysts which may be used (in each dewaxing step) have shape-selective qualities. Such catalysts include crystalline zeolite catalysts and crytalline silica alumina phosphate (SAPO) catalysts. These materials may be bound in a variety of matrices, such as those containing silica-alumina, silica and alumina or silica and alumina alone. The catalysts typically contain up to 15% metals that are known to possess a hydrogenation ability. Although the dewaxing mechanism does not require hydrogenation functionality, the metal function may, however, assist the reactivation, or regeneration process at the end of each dewaxing cycle. The preferred hydrogenation components are the noble metals of Group VIII, especially platinum and palladium, but other noble metals may also be used. Combinations of noble metals with non-noble metals, such as nickel, rhenium, tungsten, chromium and molybdenum may be employed.

The metal may be incorporated into the catalyst by any suitable method as described in Ser. No. 685,564, U.S. Pat. No. 4,648,957.

The preferred dewaxing catalysts are the zeolite dewaxing catalysts, especially the medium or intermediate pore size zeolite which are characterized by an effective pore size of generally less than about 7 Angstroms, and/or pore windows in a crystal formed by 10-membered rings. The medium or intermediate pore zeolites are represented by those zeolites having the structure of ZSM-5, ZSM-11, ZSM-23, ZSM-35, ZSM-38, ZSM-48 and TMA (tetra methyl ammonium) Offretite. These zeolites, their characteristics and utility in the present dewaxing steps are fully described in Ser. No. 685,564, U.S. Pat. No. 4,648,957, to which reference is made for such a description.

The dewaxing is preferably carried out in the presence of hydrogen to reduce catalyst aging although, as noted above, hydrogen is not necessary to participate stoichiometrically in the dewaxing reaction. The conditions employed in each dewaxing step will be as described in Ser. No. 685,564, now U.S. Pat. No. 4,648,957, to which reference is made for a full description of these conditions. Typically, the hydrodewaxing in the first and second reactors occurs under conditions which include a temperature in the range from about 400° to about 800° F. (204° to 427° C.), preferably about 500° to about 675° F. (260° to 357° C.), a pressure in the range from about 100 to about 2000 psig (8–139 bars), preferably about 350 to about 650 psig (25–46 bars). The hydrogen feed rate to the first reactor is typically in the range from about 500 to about 100,000 SCF/bbl of feedstock, preferably about 1500 to about 4000 SCF/bbl. The hydrogen feed rate to the second reactor is in the range from about 500 to about 100,000 SCF/bbl of the first liquid stream, preferably about 1500 to about 4000 SCF/bbl. The overall Liquid Hourly Space Velocity (LHSV) of the first and second hydrodewaxing reactors is in the range from about 0.25 to about 4 $hr^{-1}$, preferably about 0.5 to about 1.0 $hr^{-1}$. LHSV represents ($ft^3$/hr of reactant) per ($ft^3$ of catalyst) and the reactants are the feedstock and the first liquid stream to the respective reactors.

Interstage separation

The separation of the olefins which are to pass to the hydrotreater can be carried out under conventional fractionation conditions to produce the desired fractions. Generally, the olefins occur predominantly in the distillate and lighter fractions and so in a lube dewaxing process, the fraction boiling below the lube boiling range of 610° F.+, (320° C.+), more usually 650° F.+(345° C.), may be separated by distillation and sent to the hydrotreater. However, the light ends e.g. $C_5-$ may be separated from naphtha (end point typically 330° F. to 385° F., 165° to 195° C.) and middle distillate (330° to 650° F., 165° to 315° C., typically and the intermediate fractions removed from the dewaxing sequence while the light ends are sent to the hydrotreater and the lube fraction (610° F.+, 320° C.+, usually 650° F.+, 345° C.+) sent to the next dewaxing stage.

Interstage hydrotreating

If the hydrogenative processing of the separated light ends is carried out in a hydrotreater under conventional hydrotreating conditions, typically with a hydrotreating catalyst comprising a metal hydrogenation function on a porous, inorganic support, conventionally an oxide such as silica, alumina or silica-alumina although other supports may also be used. Because the support serves simply to bear the metal component providing the necessary hydrogenation activity and no conversion to lower boiling products is required, the support is generally substantially inert and possesses no significant acidic (cracking) activity. The metal component is typically nickel or another base metal of Group VII of the Periodic Table e.g. cobalt or molybdenum but noble metals such as platinum or palladium may also be used.

Base metal combinations such as cobalt-molybdenum or nickel-molybdenum are highly suitable. Typically, the metal component will be present in amounts up to 20 weight percent of the hydrotreating catalyst. Commercially available hydrotreating catalysts suitable for hydrotreating hydrocarbons in the selected boiling range are commercially available and may be employed.

The hydrotreating is carried out under conditions conventional for hydrotreating hydrocarbons in this boiling range, typically at an elevated temperature but at a sufficiently low level as not to inhibit the exothermic hydrogenation reactions. Temperature is therefore typically 200° to 600° F., more usually 250° to 500° F., with the range of 350°–400° F. being preferred and hydrogen pressure being consistent with system requirements, avoiding large pressure let-down and repressurisation. Pressure is therefore typically 100–2000 psig (about 8 to 140 Bar) usually 350 to 650 psig (about 25–46 Bar).

Space velocity is typically from 0.5 to 5 LHSV ($hr^{-1}$) and preferably in the range 1 to 2 LHSV. The hydrogen:hydrocarbon ratio will be determined by the hydrogen:oil ratio selected for the first stage and the cut point selected for the interstage separation. Additional hydrogen may be added to the interstage hydrotreater if desired but this is normally not required because the excess hydrogen from the first dewaxing stage will be sufficient. The proportion of olefins to be saturated in the hydrotreating step will depend on the conditions employed in the first stage dewaxing but normally again the excess hydrogen from the first stage will be sufficient to saturate the olefins, especially if the higher boiling portion of the separated fraction is withdrawn from the dewaxing sequence, as described above.

During the hydrotreating step, the olefins produced in the dewaxing step are hydrogenated to saturated products which, together with excess hydrogen, are cascaded to the subsequent dewaxing stage, thus eliminating the need for separate recycle of hydrogen to this stage.

The effect of the olefin by-products of the dewaxing process is illustrated in attached FIGS. 1 to 4. In FIG. 1, the three graphs show the operation of a pilot plant dewaxing unit using a bright stock feed and a NiZSM-5 dewaxing catalyst. After the unit lined out at 10°–50° F. pour point (first, second stages, respectively), 15% by weight 1-decene was co-introduced as a model olefin, maintaining an average reactor temperature (ART) of about 600° F. (first graph). The lube product pour point (by Autopour, equivalent to ASTM D-97) increased significantly to about 65° F. (second graph), even though space velocity was effectively reduced by the addition of the olefin (third graph).

Figure 2:
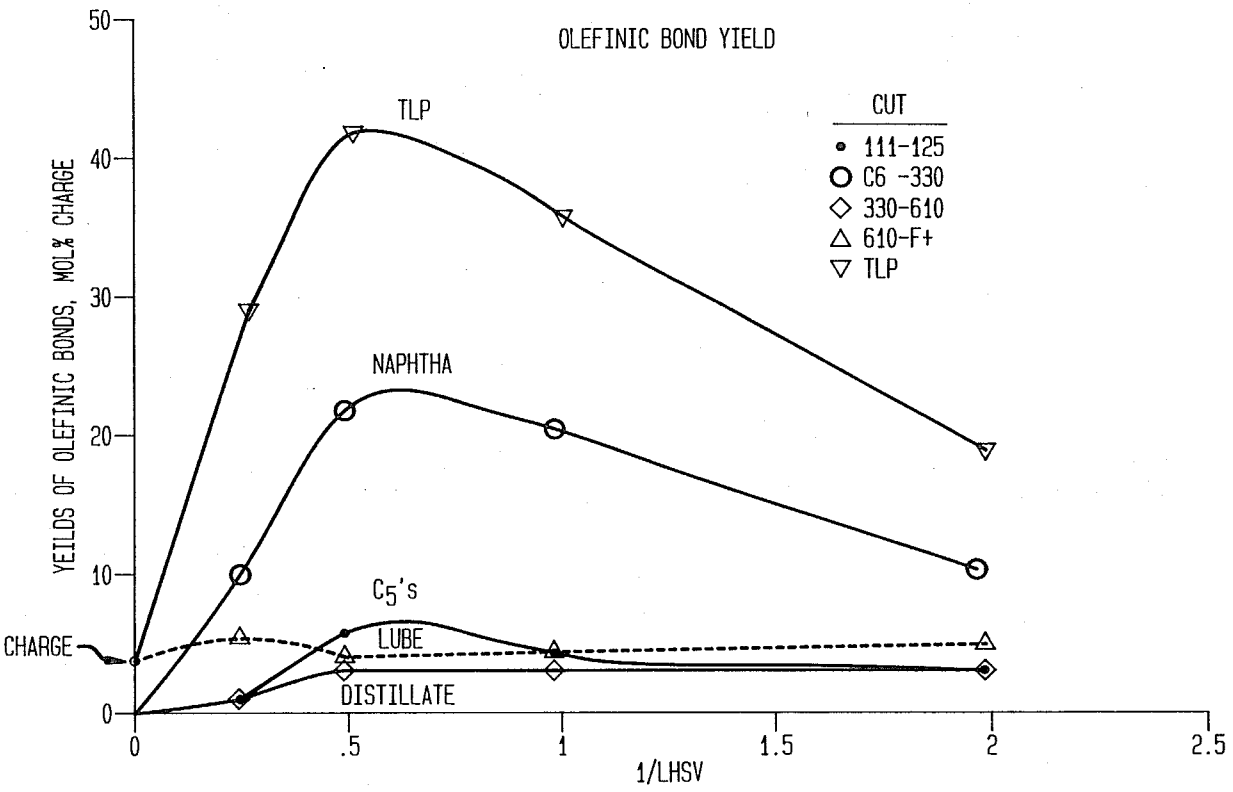

FIG. 2 shows the olefinic contents of the various product cuts obtained from the catalytic dewaxing of a light neutral lubestock over a NiZSM-5 catalyst. Comparison of the olefin contents shows that the olefins are concentrated in the distillate and lighter fractions with the most noted accumulation in the naphtha and $C_5$ fractions, especially at dewaxing severities ($LHSV^{-1}$ between 0.5 and 1). Thus, separation of the naphtha and lighter fractions will effectively remove the olefins from the subsequent stages of the dewaxing process. Accordingly, it is preferred that the separated fraction include at least the fraction boiling below about 330° F. (165° C.) or thereabouts e.g. 385° F. (about 195° C.) or 400° F. (about 200° C.).

Figure 3:
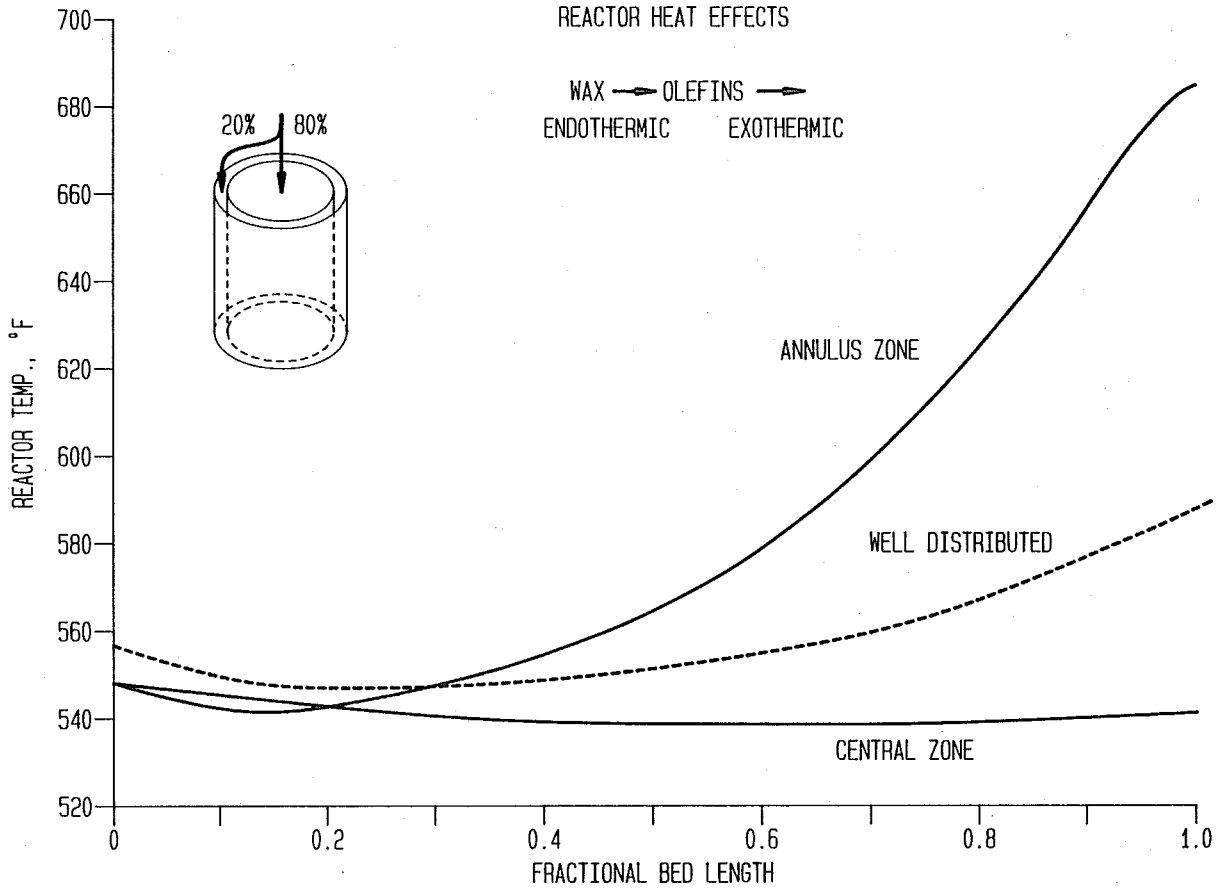

The effect of the olefins on the subsequent dewaxing stages is shown in FIG. 3. This is a mathematical simulation or reactor maldistribution with a majority of the oil phase flowing through the central zone and a majority of the gas phase through the annulus. Because hydrogen is present and the catalyst conventionally contains metal component such as nickel, hydrogenation of olefins may take place in the annular one, leading to a temperature rise of 135° F., as shown in the graph. This large temperature rise can decrease the lube yield (by promoting cracking) and degrade the quality of the lube product (by decreasing cracking selectivity).

Figure 4:
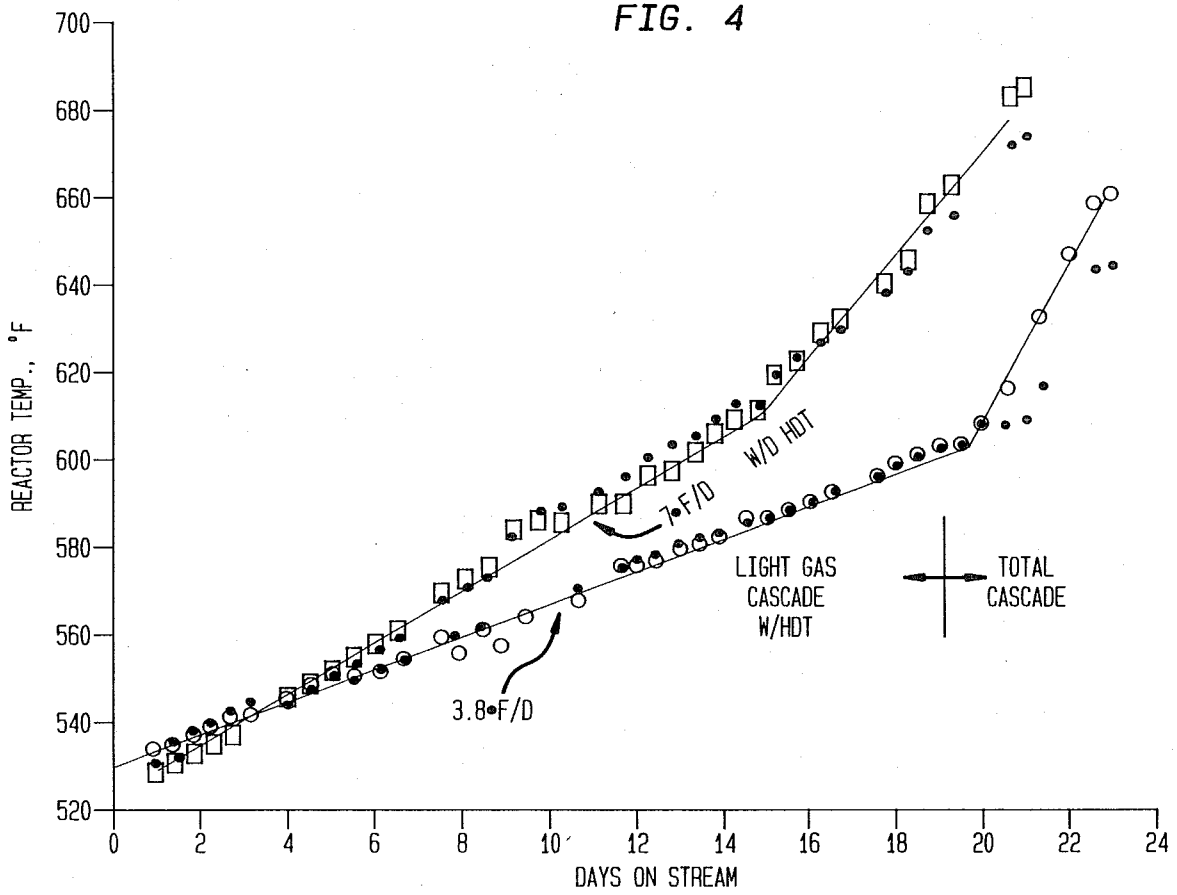

FIG. 4 is a simulation which shows that a significant reduction in catalyst aging may be achieved when the separated light ends are hydrotreated to saturate olefins. The simulation employs a model employing a light neutral or bright stock feed and a NiZSM-5 dewaxing catalyst with a pressure of 400 psig and an $H_2$:oil ratio of 2000 SCF/Bbl which is fed to the second reactor. Without hydrotreating of the cascaded first stage product, the catalyst aging rate in the second reactor is about 7° F./day (upper curve). When the light gas is hydrotreated and the hydrotreater effluent cascaded to the second stage, the aging rate was reduced to about 3.8° F./day. However, if the entire first stage effluent is hydrotreated, the aging rate increases (lower curve, right) probably due to ammonia liberation from the higher boiling lube fraction which poisons the second stage catalyst.

The effect of hydrotreating the light ends separated form the effluent from the first dewaxing reactor is shown in Table 1 below which reports the olefin concentrations, before and after interstage hydrotreating, as a proportion of the $C_5-$ fraction.

TABLE 1

| Olefin Concentration in $C_5$- Fraction | | |
|---|---|---|
| Olefin, Pct. $C_5$- | Before HDT | After HDT |
| $H_2$ | 94.6 | 94.6 |
| Ethene | 0.04 | 0 |
| Propene | 0.30 | 0.02 |
| Butenes | 0.32 | 0.01 |
| $C_5$-paraffins | 4.74 | 5.37 |
| | 100 | 100 |

Thus, by a single hydrotreating step, the troublesome olefin content is reduced to zero or to very low levels at which minimal disturbance to the dewaxing reactions will occur.

Figure 5:
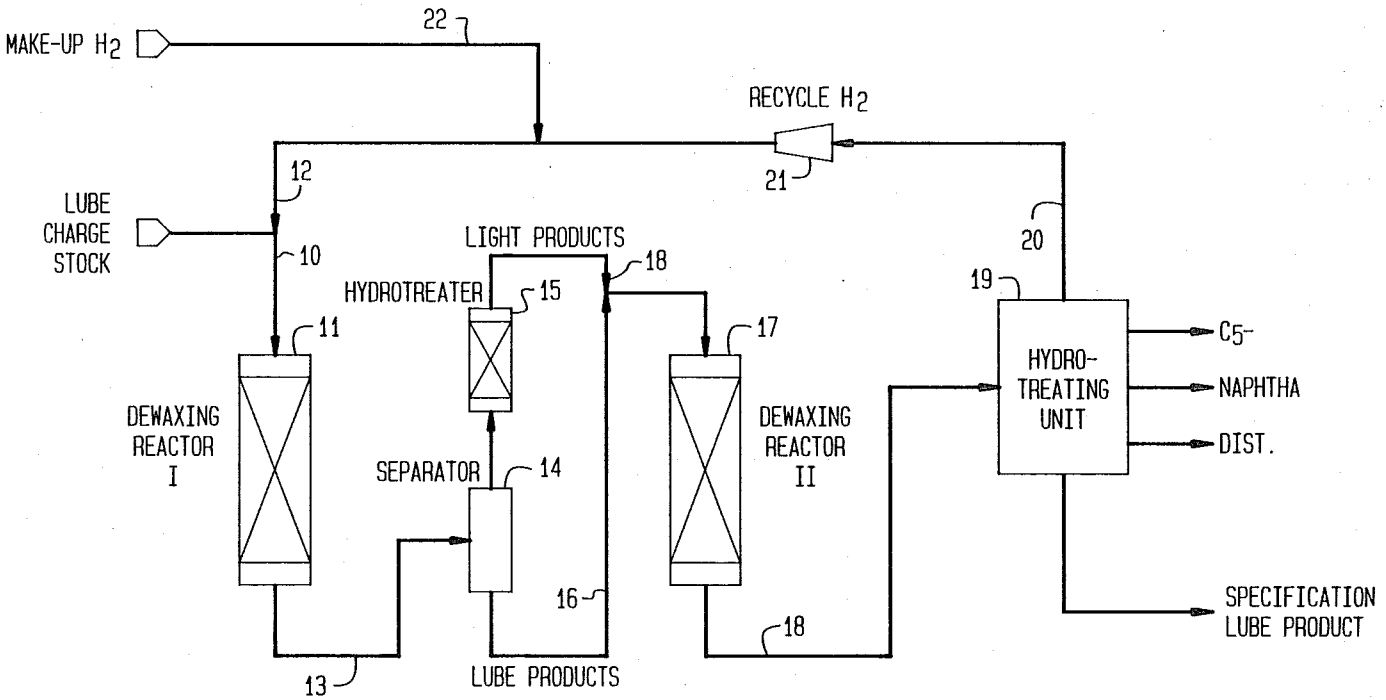
Figure 6:
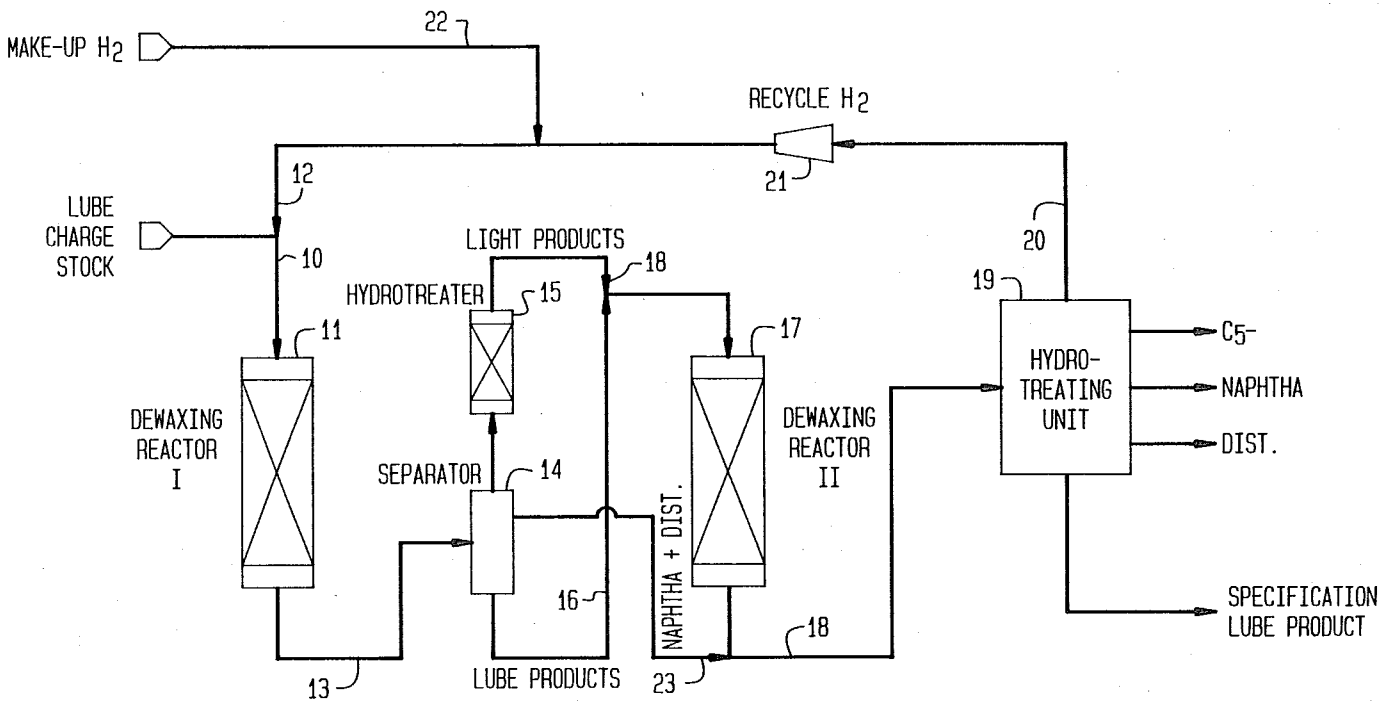

Two suitable process configurations are shown in FIGS. 5 and 6. In FIG. 5, a lube chargestock is introduced through line 10 into the first stage dewaxing reactor 11 together with hydrogen from line 12. After proceeding over the dewaxing catalyst, typically NiZSM-5, in reactor 11, the partly dewaxed effluent is led through line 13 to interstage separator 14 in which the lube (650° F.+, 345° C.+) fraction is separated from the lower boiling fractions which pass to hydrotreater 15. The separated lube fraction passes through line 16 to the second stage reactor 17 together with the hydrotreater effluent entering through line 18. The finally dewaxed produce from reactor 17 passes to hydrotreater 19 to stabilise the lube product and to improve the quality of the lower boiling fractions, after which product separation occurs in a conventional distillation unit (not shown) to produce the dewaxed lube as the high boiling fraction together with light ends, naphtha and middle distillate. Excess hydrogen from hydrotreater 19 is removed in a vapor/liquid separator (not shown) preceding the fractionator and passes through line 20 to compressor 21 to bring it up to pressure for recycling to the first reactor through line 12. Make-up hydrogen may be added through line 22. Ancillary equipment (not shown) may include hydrogen purification equipment and the like.

A similar unit is shown in FIG. 6 in which like parts have been given the same reference numerals. The difference here is that the interstage separator makes a separation into three fractions rather than two, comprising (i) the lube fraction which is passed directly to the second stage dewaxer (ii) a naphtha/distillate fraction, which is passed to hydrotreater 19 through lines 18 and 23 and (iii) light gases which are passed through the interstage hydrotreater 15 and are then cascaded as part of the hydrotreater effluent to the second stage dewaxer. Thus, the portion of the first stage product containing most of the olefins either by-passes the second stage reactor or is hydrotreated to saturate the olefins prior to entry into the second stage reactor. The withdrawn naphtha and middle distillate fractions boiling below the lube fraction contain significant quantities of olefins (see FIG. 3) and are hydrotreated in the final hydrotreater together with the effluent from the second stage dewaxer to stabilise the products and improve their quality.

If an olefinic fraction is separated and withdrawn from the dewaxing sequence as shown, for instance in FIG. 6, it need not be passed to the final hydrotreater but, instead, may be processed in an olefin oligomerisation unit as described in Ser. No. 685,564, U.S. Pat. No. 4,648,957, to which reference is made for details of the unit and its operation. Normally, however, this option will not be employed in the present process since alternative means are provided for dealing with the lighter olefins produced by the first dewaxing stage which form a suitable feed for the olefin oligomerisation unit described in Ser. No. 685,564, U.S. Pat. No. 4,648,957.

We claim:

1. A process for dewaxing a hydrocarbon feedstock by (i) catalytically dewaxing the feedstock in at least two sequential catalytic dewaxing steps in which olefins are produced during the dewaxing, (ii) separating the effluent from the first of the two catalytic dewaxing steps to produce a lower boiling fraction including olefins and a higher boiling fraction, (iii) passing the higher boiling fraction to the second of the two catalytic dewaxing steps, (iv) hydrotreating the lower boiling fraction to saturate the olefins and (v) passing the hydrotreated lower boiling fraction to the second catalytic dewaxing step.

2. A process according to claim 1 in which the feedstock comprises a lube feedstock, the lower boiling fraction comprises a fraction boiling below the lube boiling range and the higher boiling fraction comprises a partly dewaxed fraction in the lube boiling range.

3. A process according to claim 2 in which the higher boiling fraction is a 650° F.+ fraction and the lower boiling fraction is a 650° F.− fraction.

4. A process according to claim 1 in which the catalytic dewaxing steps are carried out by contract with an intermediate pore size zeolite dewaxing catalyst.

5. A process according to claim 4 in which the zeolite is ZSM-5.

6. A process according to claim 1 in which the catalytic dewaxing steps are carried out in the presence of hydrogen.

7. A process according to claim 6 in which the hydrogen is introduced into the first catalytic dewaxing step with the feedstock with hydrogen from the first catalytic dewaxing step passing to the hydrotreating step from the separation step and from the hydrotreating step to the second catalytic dewaxing step.

8. A method according to claim 7 in which effluent from the second catalytic dewaxing step is passed to a subsequent hydrotreating step, including hydrogen from the second catalytic dewaxing step.

9. A process according to claim 1 in which the light fraction includes fractions having a boiling range up to 350° F.

10. A process according to claim 1 in which the light fraction includes fractions having a boiling range up to 330° F.

11. A process for dewaxing a relatively waxy lube oil feedstock having an initial boiling point of at least 610° F., which comprises:

(i) catalytically dewaxing the feedstock in the presence of hydrogen by contact with an intermediate pore size dewaxing catalyst under dewaxing conditions to produce an effluent including a partly dewaxed product and olefins, (ii) separating the effluent to form a partly dewaxed product in the lube boiling range and a lower boiling fraction including olefins, (iii) catalytically dewaxing the partly dewaxed product in a second catalytic dewaxing step by contact in the presence of hydrogen with an intermediate pore size dewaxing catalyst, (iv) hydrotreating the lower boiling portion of the separated lower boiling fraction in an interstage hydrotreating step to saturate the olefins in that portion and form a hydrotreated effluent, (v) passing the hydrotreated effluent to the second catalytic dewaxing step.

12. A process according to claim 11 in which the entire separated lower boiling fraction is hydrotreated.

13. A process according to claim 11 in which the lower boiling portion of the lower boiling fraction is hydrotreated and the higher boiling portion of the lower boiling fraction is withdrawn from the dewaxing sequence of the catalytic dewaxing steps.

14. A process according to claim 11 in which the lower boiling portion comprises the $C_6$- fraction.

15. A process according to claim 13 in which the lower boiling portion comprises the $C_6$- fraction and the higher boiling fraction comprises naphtha and distillate boiling below the lube boiling range.

16. A process according to claim 13 in which the higher boiling portion withdrawn from the dewaxing sequence is hydrotreated.

17. A process according to claim 16 in which the higher boiling portion withdrawn from the dewaxing sequence is combined with the dewaxed effluent from the second catalytic dewaxing step and the combined fraction subjected to hydrotreating.

18. A process according to claim 11 in which the catalytic dewaxing steps are carried out in the presence of hydrogen introduced with the feedstock into the first catalytic dewaxing step, the interstage hydrotreating step being supplied with hydrogen from the first catalytic dewaxing step, the second catalytic dewaxing step being fed with hydrogen from the interstage hydrotreating step.

19. A process according to claim 11 in which the intermediate pore size zeolite in the first and second catalytic dewaxing steps is ZSM-5.

20. A process according to claim 11 in which the feedstock comprises a 650° F.+ lube feedstock.

21. A process for dewaxing a relatively waxy lube oil feedstock having an initial boiling point of at least 610° F., which comprises:

(i) catalytically dewaxing the feedstock in the presence of hydrogen by contact with an intermediate pore size dewaxing catalyst under dewaxing conditions to produce an effluent including a partly dewaxed product and olefins, (ii) separating the effluent to form a partly dewaxed product in the lube boiling range and a lower boiling fraction including olefins, (iii) catalytically dewaxing the partly dewaxed product in a second catalytic dewaxing step by contact in the presence of hydrogen with an intermediate pore size dewaxing catalyst, (iv) hydrotreating the portion of the lower boiling fraction comprising the majority of the olefins formed in the first catalytic dewaxing step in an interstage hydrotreating step to saturate the olefins, and form a hydrotreating effluent including hydrogen, (v) passing the hydrotreated effluent to the second catalytic dewaxing step.

22. A process according to claim 21 in which the portion of the lower boiling fraction subjected to the interstage hydrotreating step comprises the fraction boiling below about 330° F.

23. A process according to claim 21 in which the portion of the lower boiling fraction subjected to the interstage hydrotreating step comprises the fraction boiling below about 125° F.

24. A process according to claim 23 in which the fraction boiling range from about 125° F. to the initial lube boiling point.

25. A process according to claim 21 in which the intermediate pore size zeolite comprises ZSM-5.

* * * * *